United States Patent [19]

Riendeau

[11] 4,059,855

[45] Nov. 29, 1977

[54] RETRACTABLE COVER FOR GROUND OPENING

[76] Inventor: Carmel Riendeau, 25, boul. des Haut-Bois, Ste-Julie, Quebec, Canada

[21] Appl. No.: 739,970

[22] Filed: Nov. 8, 1976

[51] Int. Cl.[2] ..... E04H 3/16; E04H 3/18; F16L 22/02

[52] U.S. Cl. ..... 4/172.14; 4/172

[58] Field of Search ..... 4/172.12, 172.13, 172.14, 4/172, 172.11

[56] References Cited

U.S. PATENT DOCUMENTS

| | | | |
|---|---|---|---|
| 3,092,844 | 6/1963 | Brunson | 4/172.13 |
| 3,309,716 | 3/1967 | Merrit | 4/172.13 |
| 3,413,661 | 12/1968 | Ross | 4/172.13 |
| 3,903,552 | 9/1975 | Erlandsson et al. | 4/172 |
| 3,979,782 | 9/1976 | Lamb | 4/172.14 |
| 3,982,286 | 9/1976 | Foster | 4/172.14 |

*Primary Examiner*—Henry K. Artis
*Attorney, Agent, or Firm*—Diller, Brown, Ramik & Wight

[57] ABSTRACT

A retractable cover mechanism for covering an open area, such as a swimming pool. The mechanism comprises a pair of parallel channels secured on a respective opposed side of an open area to be covered. A plurality of displaceable intermediate cylinders are provided in each of the channels between displaceable end cylinders. The intermediate cylinders are water-conducting and the end cylinder at a first common end of both channels is water-conducting. The end cylinders at a second common end of both channels have solid end walls which are non-water conducting. A first extensible conduit means is secured between facing ends of adjacent ones of the intermediate and end cylinders. Attachment means are secured to at least some of the cylinders and to a cover sheet to displaceably support the cover sheet between the pair of parallel channels. First and second conduit means are connectable to a source of water pressure. The second extensible conduit means is secured between outer end walls of the end cylinders and an associated one of the first and second conduit means whereby the source of water pressure is applicable against the outer end walls of one of the end cylinders at a common end of each of the channels. Valve means is further provided to evacuate the first and second conduit means.

17 Claims, 8 Drawing Figures

RETRACTABLE COVER FOR GROUND OPENING

BACKGROUND OF INVENTION a. Field of the Invention

The present invention relates to a retractable cover mechanism for covering an open area, and more specifically but not exclusively to a retractable cover mechanism for moving a cover sheet from a storage position adjacent a swimming pool to an open position over the swimming pool.

b. Description of Prior Art

Various types of covers have been provided to cover the open area of a swimming pool whereby to isolate the water surface during winter or for other purposes or to minimize heat loss of the heated water therein. In this latter case, the cover sometimes consists of foam particles disposed on the surface of the water. A disadvantage of this is that it is difficult to remove the particles from the water and one cannot see the bottom of the pool, making it hazardous. A disadvantage of the former type of cover is that it is often necessary to inflate the cover or position inflated objects under the cover whereby snow or rain will not accumulate on the cover to make it collapse onto the pool surface.

A still further disadvantage of known prior art swimming pool covers is that these are difficult to install and therefore cannot be easily and quickly positioned and removed from a swimming pool surface area.

There thus exists a need to provide a cover for a swimming pool which is easily and quickly positioned over a swimming pool whereby to prevent debris, such as leaves, etc., from being blown into the pool when not in use, to permit more vegetation to be grown around the pool, to cover the pool's surface when not in use whereby to provide safety to people, and to reduce heat loss.

SUMMARY OF INVENTION

It is an object of the present invention to overcome the disadvantages of the prior art by providing a retractable cover mechanism which is quickly operable to position a cover sheet over a swimming pool area.

It is a further feature of the present invention to provide a retractable cover mechanism which is operated by water pressure for added safety without the use of electric power or oil pressure or lubrication.

It is a still further feature of the present invention to provide a retractable cover mechanism which is economical and storable to prevent damage thereto during winter months.

According to the above features, from a broad aspect, the present invention provides a retractable cover mechanism for covering an open area, such as a swimming pool. The mechanism comprises a pair of parallel channels secured on a respective opposed side of an open area to be covered. A plurality of displaceable intermediate cylinders are provided in each of the channels between displaceable end cylinders. The intermediate cylinders are water-conducting and the end cylinder at a first common end of both channels is water-conducting. The end cylinders at a second common end of both channels have solid end walls which are non-water conducting. A first extensible conduit means is secured between facing ends of adjacent ones of the intermediate and end cylinders. Attachment means are secured to at least some of the cylinders and to a cover sheet to displaceably support the cover sheet between the pair of parallel channels. First and second conduit means are connectable to a source of water pressure. The second extensible conduit means is secured between outer end walls of the end cylinders and an associated one of the first and second conduit means whereby the source of water pressure is applicable against the outer end walls of one of the end cylinders at a common end of each of the channels. Valve means is further provided to evacuate the first and second conduit means.

BRIEF DESCRIPTION OF DRAWINGS

A preferred embodiment of the present invention will now be described with reference to the example illustrated by the accompanying drawings in which.

DESCRIPTION OF PREFERRED EMBODIMENTS

Figure 1:
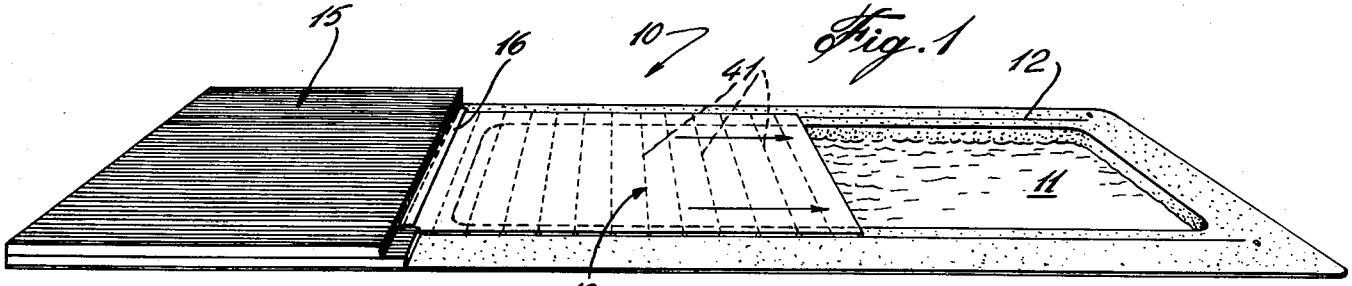
FIG. 1 is a perspective view of the retractable cover mechanism associated with a swimming pool.
Figure 2:
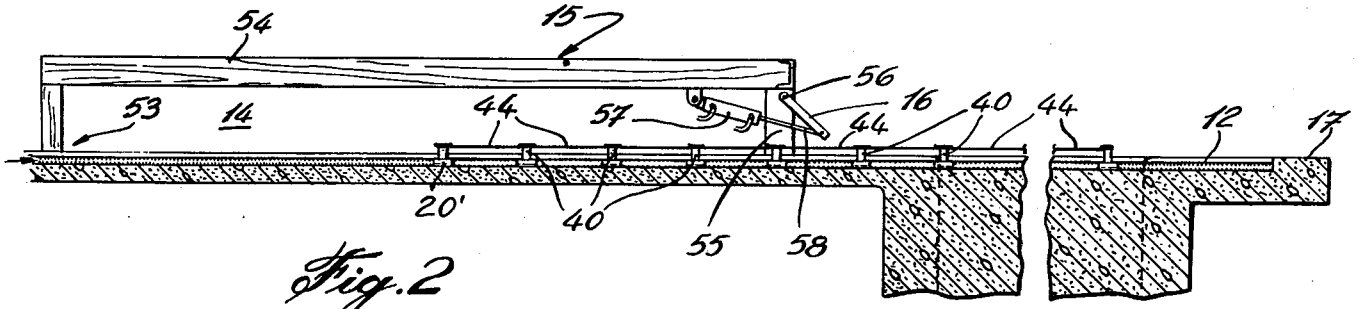
FIG. 2 is a fragmented side view of the retractable cover mechanism.

Referring now to the drawings, and more particularly to FIGS. 1 and 2, there is shown generally at 10 the retractable cover mechanism of the present invention for covering an open area 11, herein a swimming pool. The retractable cover mechanism comprises a pair of parallel channels 12 secured on a respective opposed side of the open area 11. A cover sheet 13 is displaceable from a storage position 14 in storage housing 15 located adjacent the open area 11. Herein the housing 15 is constituted by a deck which can also be utilized by the people utilizing the swimming pool. A hingeable door 16 permits entry and exit of the cover sheet 13 into the housing 15. As shown in FIG. 1, the channels 12 are embedded in concrete 17 surrounding the pool open area 11.

Figure 3:
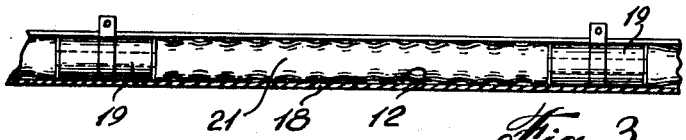
FIG. 3 is a fragmented sectional view of one of the channels illustrating the position of the cylinders when the cover sheet is extended.
Figure 4:
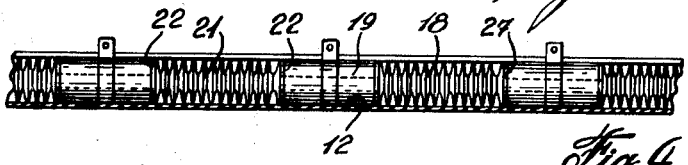
FIG. 4 is a fragmented sectional view illustrating the position of the cylinders when the cover sheet is being collapsed.

Referring now additionally to FIGS. 3 to 8, and more specifically to FIGS. 3 and 4, there is shown the construction of the channels 12 herein constituted by an elongated hollow channel member 18 of circular cross-section, such as polyvinyl chloride tube. A plurality of displaceable intermediate cylinders 19 are positioned within each channel 12 intermediate end cylinders 20 (see FIG. 8). First extensible conduit means 21, herein constituted by bellows-type tubes, are secured between facing ends 22 of adjacent ones of the intermediate and end cylinders 19 and 20, respectively.

Figure 5:
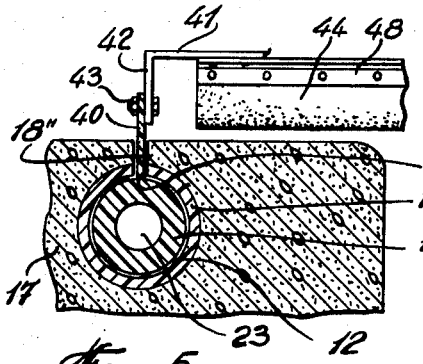
FIG. 5 is a fragmented sectional view illustrating the position of the cylinders in the channels and their attachment to the cover sheet.

As shown more clearly in FIG. 5, all the intermediate cylinders 19 and the end cylinders 20' at a common end of the channels (see FIG. 8) are provided with a through bore 23 to permit water to be displaced therethrough and through the extensible conduits 31 between each cylinder. Second extensible conduits 21' are secured between outer end walls 24 of the end cylinders 20 and an associated one of a first and second conduit 25 and 26, illustrated schematically in FIG. 8. Each cylinder 20'' is a solid core cylinder, and its operation will be described later.

The second extensible conduits 21' are also stretchable hose disposed within the channels 12. The extensible conduits 21 are of substantially equal lengths whereas the extensible conduits 21' are considerably longer to permit the end cylinders 20 at a common end of each channel to be displaced a distance sufficient to displace the cover sheet from a storage position to a position over the open area 11 of the pool.

As shown more clearly in FIGS. 3 and 4, the extensible conduits 21 have an undulated side wall and the opposed ends 27 of the conduits 21 are sealingly secured to a respective cylinder end 22 by suitable means. One end of the extensible conduits 21' is also secured in a sealing manner to the first and second conduits 25 and 26, respectively.

Figure 6:
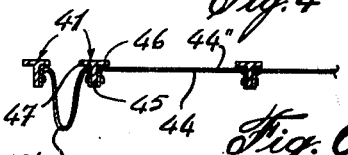
FIG. 6 is a fragmented sectional view illustrating the cover sheet in its extended and collapsed position.

Referring now more specifically to FIGS. 5 and 6, there is shown an attachment bracket 40 secured to some or all of the cylinders 19 and 20 and extending through a longitudinal slot 18' in the channel member 18. These brackets 40 are secured to the cylinders in any suitable manner known in the art, such as a clamp (not shown) rivetted about the cylinders. The cover sheet 13 is formed of a plurality of rigid transverse elongated carrier members 41 having an attachment end 42 securable to the attachment bracket 40 by suitable means such as the bolts 43 illustrated in FIG. 5. Each of the opposed ends of the carrier members 41 is secured to a respective attachment bracket 40. As is more clearly seen in FIG. 6, the brackets 41 are of T-shaped cross-section and a cover wall section 44 is secured to the downwardly extending wall section 45 of the carrier member by suitable means. A strip of rigid material 48 may be positioned along an edge and over the cover wall sections 44 to maintain them in rigid securement along the wall section 45 and under the end flanges 46 constituted by the top wall section 47 of the carrier members 41. This protects the attachment end of the cover wall sections 44 and maintains the cover wall sections taut between the carrier members 41.

When the cover sheet 13 is in its collapsed position, the cover wall sections 44 assume a position as illustrated in FIG. 6 and designated by numeral 44'. When the cover sheet is extended, it assumes a position as designated by reference numeral 44''. The carrier members 41 also maintain the cylinders 19 and 20 in transverse alignment between the channels. The cover wall sections 44 are formed of flexible sheet material such as vinyl, canvas or the like waterproof sheet materials.

Figure 7:
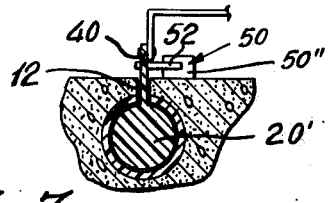
FIG. 7 is a fragmented sectional view illustrating the position of the end cylinders and a stop member.
Figure 8:
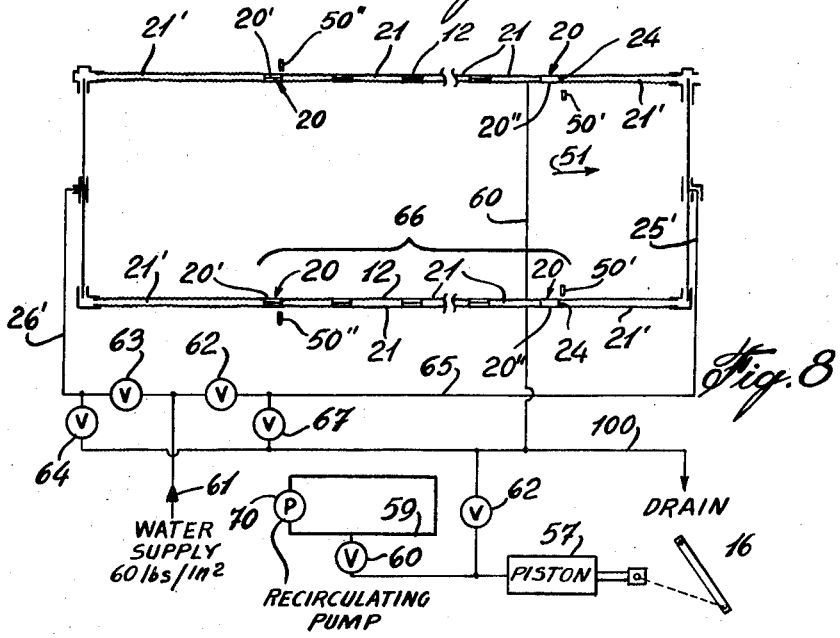
FIG. 8 is a schematic view of the retractable cover mechanism system.

Referring now to FIG. 7, there is shown a stop member 50 which is secured adjacent the channels 12 whereby to restrict the displacement of the end cylinders 20 only. As shown in FIG. 8, two of these stop members 50' are positioned adjacent the channels 12 along an inside edge thereof to arrest the displacement of the end cylinders 20'' in the direction as indicated by arrow 51 to prevent stretching of the conduits 21. Two further stop members 50'' are positioned along an outside edge of the channels 12 to arrest the displacement of the end cylinders 20' along the direction of arrow 51. A stop finger 52 is secured to the attachment bracket 40 of the end cylinders 20 to abut the stop member 50 to prevent further movement of the end cylinders. FIG. 7 illustrates the end cylinder 20' in abutment with the stop member 50''. Referring again to FIG. 1, means (not shown) is provided near the end 53 of the housing 15 to arrest the end cylinders 20' to permit the cover sheet to be collapsed and completely located in the housing under the roof 54 provided by the decking. The flap door 16 covering the entry end 55 of the housing 15 is hinged along the longitudinal top edge 56 thereof and displaceable along this hinge top edge by actuation of a piston 57 having a piston rod end 58 connected to the door 16 by proper linkages (not shown). The piston 57 is water operated and is connected to a recirculating pump circuit 59, see FIG. 8, through a valve 60.

The recirculating pump circuit 59 is that normally provided for recirculating the water in a swimming pool and the pump 70 delivers approximately 15 pounds per square inch of pressure in the circuit 59. This water pressure is applied to the piston 57 via the valve 60 when it is required to actuate the piston to cause the door 16 to open. When it is required to close the door 16, the valve 60 is closed and a second valve 62 is opened, removing the water pressure from the piston 57 by draining the water to the drain line 100 which connects to a water drain.

As shown in FIGS. 1, 5 and 7, and as previously described, the tubes 18 can be embedded in the concrete 17. The slot 18' therein is maintained in vertical alignment prior to pouring the concrete 17, by inserting a narrow board into the slot 18' and aligning the boards of each channel to be formed in parallel alignment with one another. The concrete 17 is then poured and the boards removed whereby to provide the extension portion 18'' (see FIG. 5) in the concrete permitting the attachment bracket 40 to protrude therefrom. Also, the slot 18' permits water from the pool or rainwater to seep into the channel to reduce friction between the cylinders 19 and 20 and the inside wall of the tubes 18. A drain channel 60, see FIG. 8, connects to the channels 12 and to the drain line 100 whereby to remove excess water from the channels. Of course, many drain connections (not shown) can be connected to the channels 12 to prevent water resistance in the channels. The drain could be connected on the side of the tubes 18 whereby a small quantity of water will accumulate at the bottom of the channel only.

The operation of the retractable cover mechanism will now be described with reference to FIG. 8. As shown in FIG. 8, the system is operated from a supply 61 of water pressure, herein the house or water supply, where 60 pounds per square inch of water pressure is provided. The water supply 61 is connected via hoses or pipes to the first and second conduits 25 and 26 via valves 62 and 63, respectively. As shown in FIG. 8, the retractable cover mechanism is in its extended position with the cover sheet (not shown) fully extended. Thus, the end cylinders 20' are in abutment against the stop members 50'. In order to displace the cover sheet to its storage position in the housing 15, it if firstly necessary to open the hinge door 16 of the housing 15. This is accomplished, as previously described, by opening the valve 60 of the circulating pump circuit 59. Thereafter, a valve 64 is opened to connect the second conduit 26 with the drain line 100. This will permit escapement of water and air in the extensible conduit 21' and the second conduit 26. The valve 63 is in its closed position and the valve 62 is then opened. This connects the water supply 61 via conduit 65 to the first conduit 25 and the water pressure is then exerted against the outer ends 24 of the end cylinders 20''. This pressure then displaces the water between the cylinders through the bores 23 in the intermediate cylinders and out through the bore of the end cylinder 20'. This causes the cylinders to come closer to each other and the cover sheet to collapse in an accordion fashion. As the cylinders come closer to each other, the entire cylinder assembly 66 also is displaced towards the second conduit and the extensible conduit 21' further collapses in accordion fashion. The water simply runs out from the end of the extensible conduit 21' through the second conduit 26, the valve 64 and into the drain line 100. Thus, there is little resistance offered by the water seeping out through the end cylinder 20'. Also, the carrier members 41 maintain the cylinders in alignment. If necessary, further alignment means may be secured transversely of the cylinders or longitudinally thereof to maintain them in alignment. This would cause the cylinders to move closer together in transverse alignment whereby to prevent jamming. Further, as seen in FIG. 8, the feed lines 25' and 26' are connected centrally to the first and second conduits 25 and 26 to maintain equilibrium pressure within the two cylinder assemblies and also within the extensible conduits 21'. Once the cylinder assembly 66 is totally collapsed and in the housing 15, the valve 60 is closed and the valve 62 opened to remove the water pressure from the piston 57 to cause the door 16 to close.

When it is necessary to move the cylinder assembly to position the cover sheet 13 over the open area 11 of the pool, the door 16 is opened in the same manner as above described. The valve 67 is opened to connect the first conduit 25 to the drain line 100. The valve 64 is closed and the valve 63 is open whereby to connect the water supply 61 to the second conduit. This applies water pressure against the end wall 24 of the end cylinder 20'. However, water will flow through the through bore 23 in the end cylinder 20' and through the bore of all of the intermediate cylinders 19. This will cause expansion of the extensible conduits 21 causing the entire cylinder assembly 66 to be fully extended and to be displaced in the channels 12 until the end cylinder 20' hits the stop member 50'. To fully extend the cylinder assembly, the water pressure acts rearwardly from the stationary end cylinder to displace the intermediate cylinders to their full extension. Then, the valve 63 can be closed as the cover sheet 13 is in an extended position over the open area 11.

Any obvious modifications of the above-described example of the preferred embodiment are intended to be covered herein, provided such modifications fall within the broad definition of the invention as defined by the appended claims. For example only, the channels 12 could be supported above a ground surface and be provided by a rigid pipe having a slot on the top side thereof. Also, the cover sheet 13 may be differently constructed and supported between the cylinders 19 and 20. Still further, the channel and the cylinders may not necessarily be of circular cross-section and could conceivably be of square cross-section. Still further, the open area may not necessarily be a swimming pool and it is conceivable that the retractable cover mechanism be utilized to operate a retractable roof sheet or window screens or in other similar applications. Further, all the valves for operating the mechanism can be located on a control panel with operating instructions. This panel may also be locked to prevent anyone from removing the cover from the pool area when the owner is away. Alternatively, the cover can be locked directly in its extended position. Also, the ladders leading to the pool may be mounted on tracks to displace them from interference with the cover.

I claim:

1. A retractable cover mechanism for covering an open area, said mechanism comprising a pair of parallel channels secured on a respective opposed side of an open area to be covered, a plurality of displaceable intermediate cylinders in each of said channels between displaceable end cylinders, said intermediate cylinders and said end cylinder at a first common end of both said channels being water conducting, said end cylinders at a second common end of both said channels having solid end walls which are non-water conducting, first extensible conduit means secured between facing ends of adjacent ones of said intermediate and end cylinders, attachment means secured to at least some of said cylinders and to a cover sheet to displaceably support said cover sheet between said pair of parallel channels, first and second conduit means connectable to a source of water pressure, second extensible conduit means secured between outer end walls of said end cylinders and an associated one of said first and second conduit means whereby said source of water pressure is applicable against said outer end walls of one of said end cylinders at a common end of each of said channels, and valve means to evacuate said first and second conduit means.

2. A retractable cover mechanism as claimed in claim 1 wherein each of said channels is an elongated hollow channel member of circular cross-section, said end cylinders at said first common end and said intermediate cylinders having a longitudinal bore therethrough whereby water can flow therethrough, said hollow channel member having a longitudinal slot to permit passage therethrough of said attachment means.

3. A retractable cover mechanism as claimed in claim 2 wherein said channel member is a plastic tube, said attachment means being a clamp member secured to each of said cylinders and displaceable along said slot.

4. A retractable cover mechanism as claimed in claim 2 wherein said channel member is an elongated tube embedded in concrete on each said opposed sides of said open area, said longitudinal slot extending through said concrete and through which said attachment means project.

5. A retractable cover mechanism as claimed in claim 2 wherein there is further provided a drain conduit, said drain conduit being connected to said channels and to said valve means to evacuate said first and second conduit means.

6. A retractable cover mechanism as claimed in claim 2 wherein said first and second extensible conduit means is stretchable hose disposed within said channels, said stretchable hose constituting said first extensible conduit means being of substantially equal lengths, said stretchable hose constituting said second extensible conduit means being considerably longer than said first extensible conduit means to permit said end cylinders at a common end of each of said channels to be displaced a distance sufficient to displace said cover sheet from a storage position adjacent said open area to an extended position over said open area.

7. A retractable cover mechanism as claimed in claim 6 wherein said stretchable hose has an undulated side wall, said hose having opposed open ends sealingly secured to respective cylinder ends or said associated one of said first and second conduit means.

8. A retractable cover mechanism as claimed in claim 1 wherein a stop member is associated with each of said end cylinders to restrict displacement thereof in said channels and to permit said cover sheet to be extended over said open area.

9. A retractable cover mechanism as claimed in claim 1 wherein there is further provided a storage housing having roof means for storing said cover sheet, said storage housing being positioned adjacent an end of said open area, said channels extending within said storage housing.

10. A retractable cover mechanism as claimed in claim 9 wherein said end cylinders facing said storage housing are arrested when moved in said housing to permit said cover sheet to be completely located in said housing.

11. A retractable cover mechanism as claimed in claim 10 wherein said housing is provided with a side opening for entry and exit of said cover, a hinged door covering said side opening, said hinged door being hinged on a longitudinal top edge thereof and displaceable on said top edge by actuation of a piston having a piston rod end connected to said door, said piston being actuated by connection through a valve to a recirculating pump circuit.

12. A retractable cover mechanism as claimed in claim 1 wherein said source of water pressure is a household water supply of approximately 60 lbs./sq. in., said first and second conduit means being tubular conduits connected to said water supply via respective shut-off valves, said valve means being two valve elements connected to a respective one of said tubular conduits downstream of said shut-off valves to interconnect said tubular conduits with a drain conduit.

13. A retractable cover mechanism as claimed in claim 1 wherein said cover sheet is comprised of a plurality of rigid transverse elongated carrier members interconnected at each opposed end to an attachment bracket of a respective one of said cylinders, a cover wall section spanning adjacent carrier members, said cover wall section being collapsible as said carrier members are displaced closer together and being extended as said carrier members move further away from one another, said carrier members being displaced transversely by displacement of said cylinders in said channels.

14. A retractable cover as claimed in claim 13 wherein said cover sheet is of flexible sheet material, such as vinyl, canvas or the like materials, said open area being a swimming pool.

15. A method of displacing a cover sheet over an open area, said method comprising the steps of:

i. providing a plurality of displaceable cylinders in a pair of channels extending parallel to one another on a respective side of said open area, said cylinders being secured to said cover sheet to displace it between said pair of channels; and ii. applying water pressure to said cylinders to displace them in a predetermined manner relative to one another to cause said sheet to be displaced over and away from said open area.

16. A method as claimed in claim 15 wherein said step (ii) comprises a. displacing said cylinders closer or further from one another whereby said cover sheet will fold in an accordion fashion or extend, and b. displacing said cylinders from adjacent said open area to a storage area remote from said open area.

17. A method as claimed in claim 16 wherein said steps (a) and (b) are effected by applying water pressure at the ends of end cylinders at a common end of said pair of channels whilst evacuating the area between cylinders to cause said cylinders to be displaced in a predetermined direction.

* * * * *